US006075442A

United States Patent [19]

Welch

[11] Patent Number: 6,075,442

[45] Date of Patent: Jun. 13, 2000

[54] LOW POWER CHILD LOCATOR SYSTEM

[75] Inventor: Bryan J. Welch, Northglenn, Colo.

[73] Assignee: Lucent Technoilogies Inc., Murray Hill, N.J.

[21] Appl. No.: 09/272,151

[22] Filed: Mar. 19, 1999

[51] Int. Cl.[7] ..... G08B 23/00

[52] U.S. Cl. ..... 340/573.1; 340/539; 340/574; 343/702

[58] Field of Search ..... 340/573.1, 825.36, 340/825.49, 539, 505, 574; 343/898, 702

[56] References Cited

U.S. PATENT DOCUMENTS

| | | | |
|---|---|---|---|
| 4,961,575 | 10/1990 | Perry | 340/573.1 |
| 5,170,172 | 12/1992 | Weinstein | 340/573.1 |
| 5,289,163 | 2/1994 | Perez et al. | 340/539 |
| 5,365,219 | 11/1994 | Wong et al. | 340/573.1 |
| 5,525,967 | 6/1996 | Azizi et al. | 340/573.1 |
| 5,652,569 | 7/1997 | Gerstenberger et al. | 340/539 |
| 5,771,001 | 6/1998 | Cobb | 340/573.1 |
| 5,790,022 | 8/1998 | Delvecchio et al. | 340/573.1 |
| 5,877,675 | 3/1999 | Rebstock et al. | 340/573.1 |
| 5,900,817 | 5/1999 | Olmassakian | 340/573.1 |

*Primary Examiner*—Jeffery A. Hofsass
*Assistant Examiner*—Anh La
*Attorney, Agent, or Firm*—Duft, Graziano & Forest, P.C.

[57] ABSTRACT

The low power child locator system consists of a lightweight, low power radio frequency transmitter beacon worn by the child and a radio frequency directional receiver that can be used to direct the user to the radio frequency beacon transmitter. The transmitter can be programmed to generate a unique signal to prevent its output radio signal from being received by another receiver. The transmitter-receiver pair therefore communicates to the exclusion of other transmitters and receivers that are operational in the vicinity of the transmitter-receiver pair. Since the child is assumed to not have traveled a great distance from their original location, the radio frequency directional receiver operates as a simple signal strength indicator, using a plurality of narrow beam antennas to enable the user to vector in on the transmitted signal. Each of the plurality of directional antennas is capable of receiving radio signals of predetermined characteristics exclusively from a narrowly defined region of space which is located proximate to the ground and radially extending outward from the directional antenna. A plurality of indicators, each associated with at least one of the plurality of directional antennas and capable of a variable range of illumination magnitude are used in conjunction with a signal strength detector. The signal strength detector activates the plurality of indicators as a function of the identified strength of the radio signals received from each of the associated plurality of directional antennas to thereby indicate the direction from which the radio signals emanate.

8 Claims, 2 Drawing Sheets

LOW POWER CHILD LOCATOR SYSTEM

FIELD OF THE INVENTION

This invention relates to personnel locator systems and in particular to an inexpensive radio beacon system that can be used as a child locator system, which consists of a low power radio frequency transmitter beacon worn by the child and a radio frequency directional receiver that can be used to direct the user to the radio frequency beacon transmitter.

PROBLEM

It is a problem in the field of personnel locator systems that the personnel to be located can roam within an area that has characteristics that render precise location of an individual a difficult task. This is due to the fact that the personnel are either located in the open, roaming over a large expanse of territory, or located within the confines of a building, which typically has multiple floors and a large number of rooms and hallways. The radio signals that are transmitted by these personnel locator systems must therefore be of reasonable power output and signal characteristics to enable the locator processor to receive adequate information to unambiguously identify the location of the signal source. To make such a personnel locator system operational in these environments, the transmitter portion of the system must have a considerable power output to enable the signals to be transmitted a great distance in the case of the open area environment, or through radio signal obstructing features in the case of the building environment. In addition, the extent and/or complexity of the space to be monitored requires the provision of a complex and physically large monitoring system to differentiate among many signals that are received and to triangulate on the selected transmitter that is of present interest. As a result, the personnel locator system is both complex and expensive, with both the transmitted and monitoring system being large and power intensive.

In the case where the personnel to be located is a small child, their range of wandering is typically limited to the vicinity of the responsible guardian, whether within the confines of a building or out in an open area. Therefore the required operational range of the personnel locator system can be significantly reduced. However, there is presently no personnel locator system that is both simple to use and inexpensive to address the needs of this market. The existing personnel locator systems are bulky and not portable. Their underlying architecture is not readily extensible to the simple application of a child locator application, since they are designed for the above-noted environments.

SOLUTION

The above described problems are solved and a technical advance achieved by the present low power child locator system which consists of a lightweight, low power radio frequency transmitter beacon worn by the child and a radio frequency directional receiver that can be used to direct the user to the radio frequency beacon transmitter. The transmitter can be programmed to generate a unique signal to prevent its output radio signal from being received by another receiver. The transmitter-receiver pair therefore communicates to the exclusion of other transmitters and receivers that are operational in the vicinity of the transmitter-receiver pair. Since the child is assumed to not have traveled a great distance from their original location, the radio frequency directional receiver operates as a simple signal strength indicator, using a plurality of narrow beam antennas to enable the user to vector in on the transmitted signal. Each of the plurality of directional antennas is capable of receiving radio signals of predetermined characteristics exclusively from a narrowly defined region of space which is located proximate to the ground and radially extending outward from said directional antenna. A plurality of indicators, each associated with at least one of said plurality of directional antennas and capable of a variable range of illumination magnitude are used in conjunction with a signal strength detector. The signal strength detector activates the plurality of indicators as a function of the identified strength of the radio signals received from each of the associated plurality of directional antennas to thereby indicate the direction from which the radio signals emanate.

DETAILED DESCRIPTION

Figure 1:
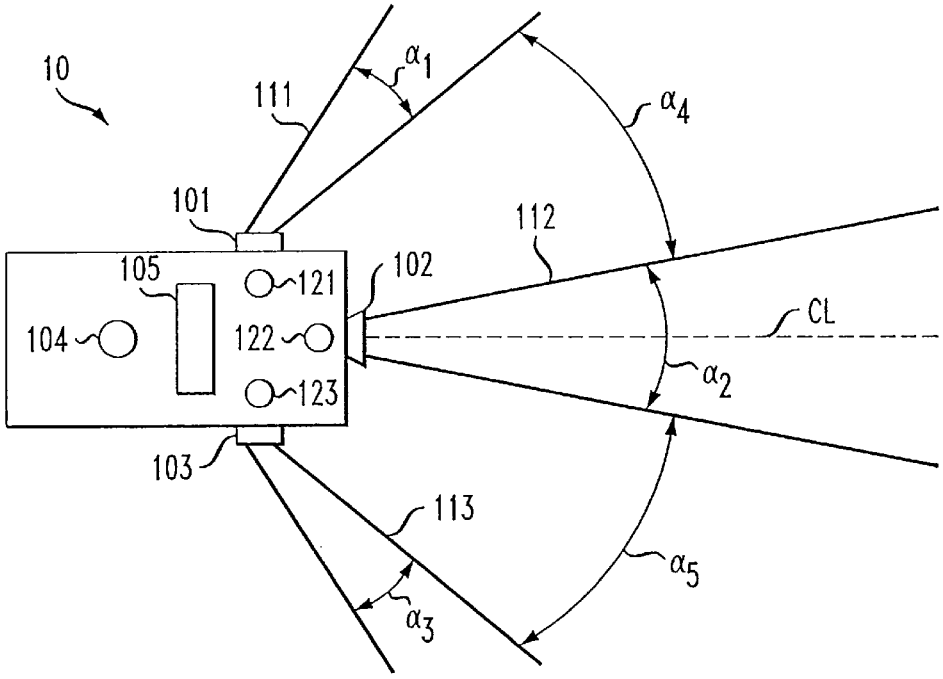
FIGS. 1 and 2 illustrate top plan and side plan views of the receiver device of the present low power child locator system.
Figure 2:
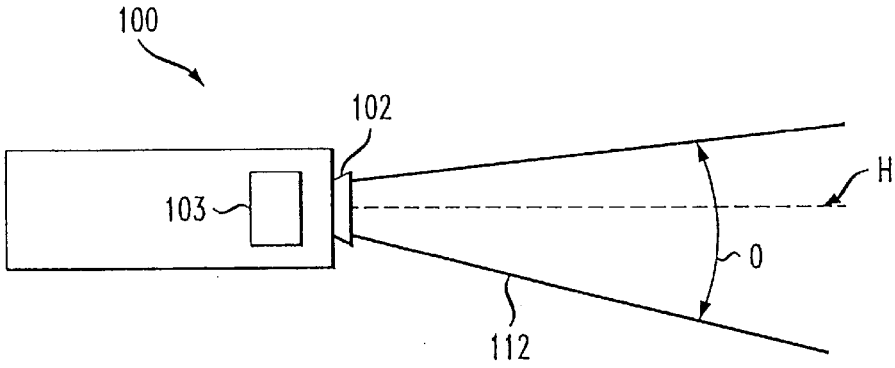
Figure 3:
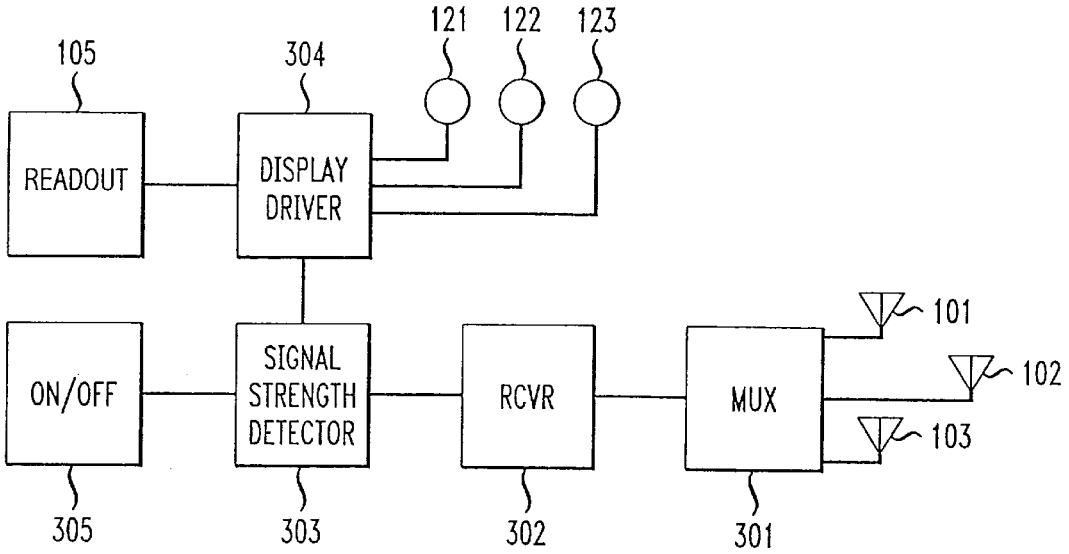
FIG. 3 illustrates in block diagram form the circuitry contained in the present low power child locator system.
Figure 4:
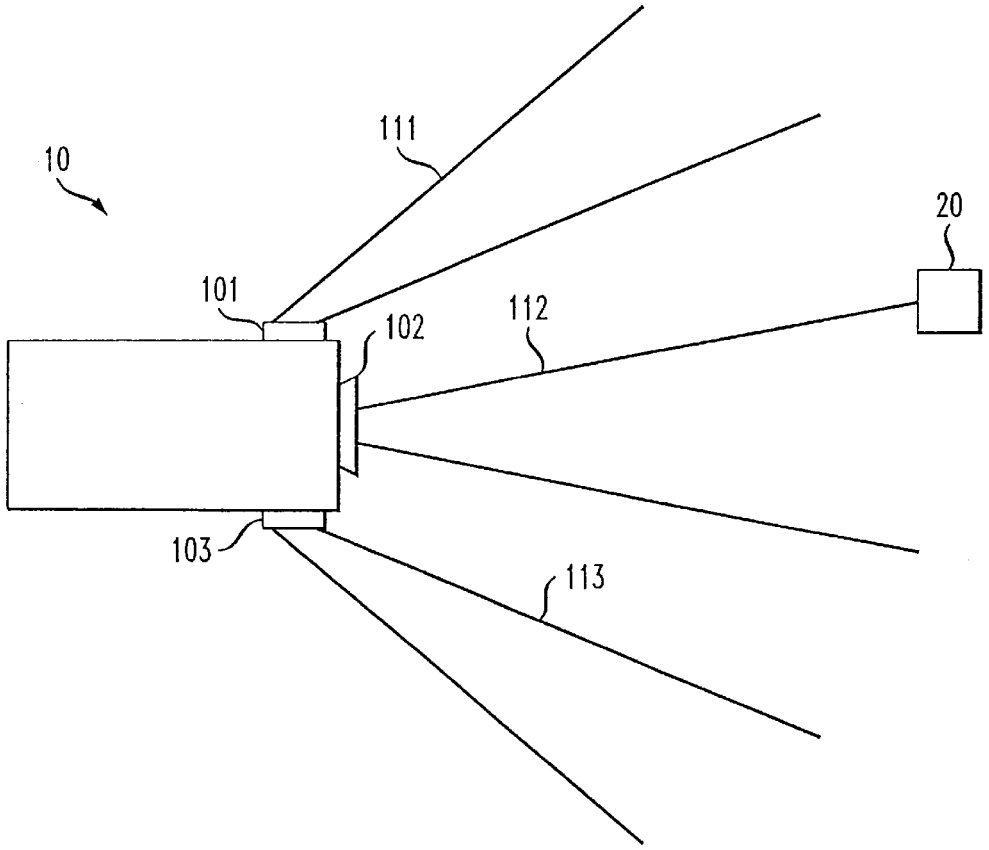
FIG. 4 illustrates in block diagram form the present low power child locator system in a typical operating environment.

FIGS. 1 and 2 illustrate top plan and side plan views of the receiver device of the present low power child locator system, FIG. 3 illustrates in block diagram form the circuitry contained in the present low power child locator system, and FIG. 4 illustrates in block diagram form the present low power child locator system in a typical operating environment. The low power child locator system 100 consists of a lightweight, low power radio frequency transmitter beacon 20 worn by the child and a radio frequency directional receiver 10 that can be used to direct the user to the radio frequency beacon transmitter. The transmitter 20 can be programmed to generate a unique signal to prevent its output radio signal from being received by another receiver. The transmitter-receiver pair therefore communicates to the exclusion of other transmitters and receivers that are operational in the vicinity of the transmitter-receiver pair. Since the child is assumed to not have traveled a great distance from their original location, the radio frequency directional receiver operates as a simple signal strength indicator, using a plurality of narrow beam antennas 101–103 to enable the user to vector in on the transmitted signal. Each of the plurality of directional antennas 101–103 is capable of receiving radio signals of predetermined characteristics exclusively from a narrowly defined region of space a which is located proximate to the ground and radially extending outward from said directional antenna. A plurality of indicators 121–123, each associated with at least one of said plurality of directional antennas 101–103 and capable of a variable range of illumination magnitude are used in conjunction with a signal strength detector 303. The signal strength detector 303 activates the plurality of indicators 121–123 as a function of the identified strength of the radio signals received from each of the associated plurality of directional antennas 101–103 to thereby indicate the direction from which the radio signals emanate.

As shown in FIGS. 1 and 2, each antenna 101–103 has an antenna pattern of horizontal angular extent $\alpha_1$–$\alpha_3$, with the forward pointing antenna pattern 112 being separated from the other two antenna patterns 111, 113, located one on each side of the forward pointing antenna pattern 112, by an angle $\alpha_4$, $\alpha_5$. The plurality of antennas 101–103 have a vertical antenna pattern as shown in FIG. 2, consisting of a vertical angle of θ, primarily extending in a downward direction from the horizontal which is indicated by the dotted line H. The vertical antenna pattern of the antennas 101–103 consists of a fairly narrow width beam with the top of the beam being substantially parallel to the ground. Thus, the radio frequency directional receiver 10 has a plurality of distinct, substantially non-overlapping (in its nominal range of operation) "view fields" of antenna patterns 111–113 which are located proximate to the ground and radially extending outward from the respective directional antennas 101–103. This enables the user to rotate the radio frequency directional receiver 10 in a horizontal direction to "point" to the radio transmitter 20.

The plurality of directional antennas 101–103 can be multiplexed via multiplexor 301 to a radio frequency receiver 302 which receives the signals that are detected by the associated directional antennas 101–103. The output of the radio frequency receiver 302 is transmitted to the signal strength detector 303 which measures the strength of the radio transmissions received by each of the directional antennas 101–103. The determined signal strength represents a measure of the range of the radio transmitter 20 from the radio frequency directional receiver 10 and the relative signal strengths among the plurality of directional antennas 101–103 represents an indication of the direction of the radio transmitter 20 with respect to the radio frequency directional receiver 10. The signal strength determinations that are made by the signal strength detector 303 are translated into a pattern of illumination, which pattern is transmitted in the form of control signals to the display driver 304 to activate the display devices 121–123. While three individual display devices 121–123 (one each associated with a corresponding one of the plurality of directional antennas 101–103) are shown in FIG. 1, any number of display types can be used, such as an arc consisting on numerous individual display devices, a rectangular display device, a bar display device that can display a moving pointer, and the like. In any case, the display device(s) are activated to visually indicate the direction of the radio transmitter 20 with respect to the radio frequency directional receiver 10.

TRANSMITTER SIGNAL CODING

The transmitter can be programmed to generate a unique signal to prevent its output radio signal from being received by another receiver. The transmitter-receiver pair therefore communicates to the exclusion of other transmitters and receivers that are operational in the vicinity of the transmitter-receiver pair. This can be accomplished by the use of PIN code as in garage door openers where the transmitter outputs a radio frequency signal of predetermined frequency and having a coded digital output that uniquely identifies the transmitter. The coded PIN number is detected and decoded by the receiver 302 and discarded if the PIN code does not match that programmed into the radio frequency directional receiver 10. If the PIN code does match, then the signal is passed to the signal strength detector 303 to obtain a measure of the strength of the received signal, which is an indication of the distance between the radio frequency directional receiver 10 and the radio transmitter 20. In addition, the PIN number can be translated into a textual identification of the identity of the individual who is in possession of the radio transmitter 20, and this textual information displayed on readout 105, via display driver 304. Thus, the radio frequency directional receiver 10 can be used with multiple radio transmitters 20. In addition the readout 105 can be used to display a range measurement indicative of the distance between the radio transmitter 20 and the radio frequency directional receiver 10.

RADIO SIGNAL CHARACTERISTICS

The radio frequency signal that is used in the present low power child locator system is selected to account for the particular operating environment in which the present low power child locator system is used. In particular, a high frequency radio signal provides good directional response for outdoor applications but has a significant amount of signal reflections, such as multi path reflections off the ground and intervening objects. A low frequency radio signal provides poor directional response for outdoor applications but has a minimal amount of signal reflections, and is therefore advantageous for use in indoor applications. Therefore, the present low power child locator system can mode switch between indoor and outdoor environments, under control of the user via a mode setting switch 106. The radio frequency selected should correspond to the spacing between the three directional antennas 101–103 which are separated by a distance to create a phase change between the signals received at each antenna. In addition, the front corners of the housing of the radio frequency directional receiver 10 between the antennas 101, 102 and 102, 103 can contain radio frequency shields to block the signals received by the front antenna 102 from reaching the other two antennas 101, 103.

SUMMARY

Thus, the present low power child locator system includes a radio frequency directional receiver, which uses a plurality of narrow beam antennas capable of receiving radio signals exclusively from a narrowly defined region of space located proximate to the ground and radially extending outward from said directional antenna. A plurality of indicators are used in conjunction with a signal strength detector to indicate the identified strength of the radio signals received to thereby indicate the direction from which the radio signals emanate.

What is claimed:

1. A low power child locator system for identifying a direction from which radio signals of predetermined characteristics emanate comprising:

a plurality of directional antenna means, each directional antenna means capable of receiving said radio signals of predetermined characteristics exclusively from a narrowly defined region of space which is located proximate to the ground and radially extending outward from said directional antenna means;

a plurality of display devices, each associated with at least one of said plurality of directional antenna means and configured to visually display a signal strength of said radio signals of predetermined characteristics received by said associated plurality of directional antenna means:

means for identifying a strength of said radio signals of predetermined characteristics received from each of said plurality of directional antenna means; and means for activating said plurality of display devices as a function of said identified strength of said radio signals of predetermined characteristics received from each of said associated plurality of directional antenna means.

2. The low power child locator system of claim 1 wherein said plurality of directional antenna means comprises:

a first antenna means having an antenna pattern oriented to point in a forward direction; and second and third antenna means, each having an antenna pattern oriented to point in a direction laterally to either side of said first antenna means antenna pattern.

3. The low power child locator system of claim 2 wherein said plurality of directional antenna means have antenna patterns having an upper range substantially parallel to the ground when said low power child locator system is held parallel to the ground.

4. The low power child locator system of claim 1 wherein said plurality of display devices are capable of a variable range of illumination magnitude.

5. The low power child locator system of claim 1 wherein said plurality of display devices further comprises:

textual readout means for visually displaying alphanumeric data representative of an identity of a source of said radio signals of predetermined characteristics.

6. The low power child locator system of claim 1 wherein said means for identifying comprises:

signal strength detector means for calculating a strength of said radio signals of predetermined characteristics as received at each of said plurality of antenna means.

7. The low power child locator system of claim 1 wherein said means for activating comprises:

means for differentially illuminating said plurality of illumination means to visually indicate a direction with respect to said low power child locator system from which said radio signals of predetermined characteristics are emanating.

8. The low power child locator system of claim 1 further comprising:

mode switch means for switching between at least two operating frequencies of said radio signals of predetermined characteristics.

* * * * *